US006227306B1

(12) United States Patent
Downie et al.

(10) Patent No.: US 6,227,306 B1
(45) Date of Patent: May 8, 2001

(54) PIPE GRIPPING DEVICE

(75) Inventors: R. James Downie, Okotoks; Matthew Brown, Calgary, both of (CA)

(73) Assignee: Tesco Corporation, Calgary (CA)

( * ) Notice: Subject to any disclaimer, the term of this patent is extended or adjusted under 35 U.S.C. 154(b) by 0 days.

(21) Appl. No.: 09/695,923

(22) Filed: Oct. 26, 2000

Related U.S. Application Data

(62) Division of application No. 09/178,064, filed on Sep. 21, 1998.

(60) Provisional application No. 60/063,208, filed on Oct. 27, 1997.

(51) Int. Cl.[7] ..... E21C 5/06; B23Q 5/027

(52) U.S. Cl. ..... 173/55; 173/53; 173/147; 173/149

(58) Field of Search ..... 173/55, 53, 56, 173/141, 152, 149, 164, 147

(56) References Cited

U.S. PATENT DOCUMENTS

| | | |
|---|---|---|
| 3,131,776 | 5/1964 | Kvello-Aone et al. . |
| 3,692,123 | 9/1972 | Gyongyosi . |
| 4,258,796 | 3/1981 | Horning et al. . |
| 4,456,077 | 6/1984 | Lagekstedt et al. . |
| 4,458,764 | 7/1984 | Lidstrand . |
| 4,478,292 | 10/1984 | Baugh et al. . |
| 5,343,962 | 9/1994 | Daigle et al. . |

*Primary Examiner*—Scott A. Smith
(74) *Attorney, Agent, or Firm*—Bennett Jones

(57) ABSTRACT

A pipe gripping device is taught which is useful for moving pipe into and/or out of a well. The pipe gripping device includes a first set of slips for holding a pipe in a pipe light condition and a second set of slips for holding a pipe in a pipe heavy condition. The second set of slips are actuatable independently from the first set of slips. The pipe gripping device can include a slip moving system which prevents the slip carrier blocks from being driven outwardly against the housing, to thereby prevent the carrier blocks from locking, by being driven against the housing.

9 Claims, 10 Drawing Sheets

FIG. 9A
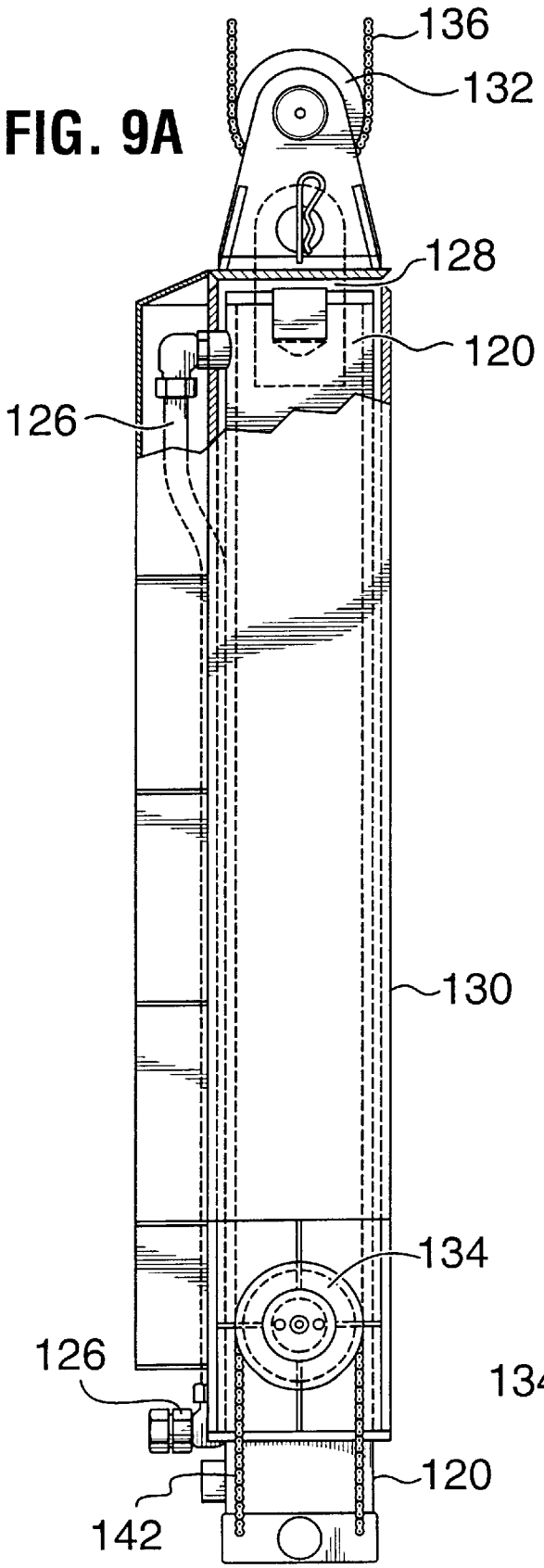
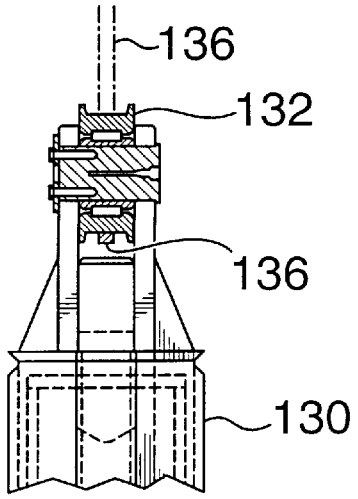
FIG. 9B
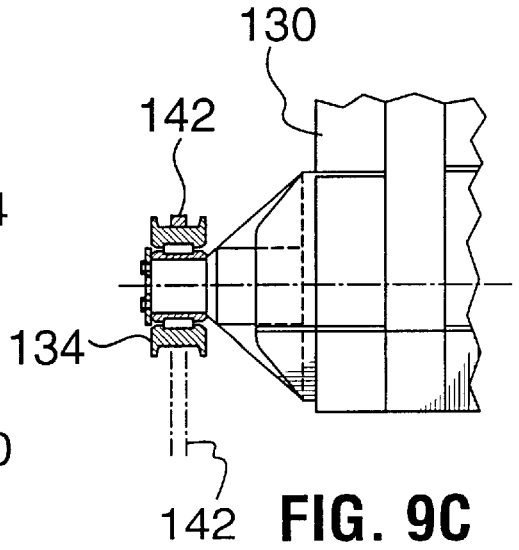
FIG. 9C

PIPE GRIPPING DEVICE

This is a divisional application of U.S. Ser. No. 09/178,064, pending which is incorporated herein by reference. This application claims subject matter disclosed in prior filed provisional application Ser. No. 60/063,208, filed Oct. 27, 1997.

FIELD OF THE INVENTION

This invention relates to a pipe gripping device for use in a pipe push/pull machine or the like.

BACKGROUND OF THE INVENTION

Pipe handling devices, commonly called snubbing or pipe push/pull machines, are used in drilling operations to push pipe into and pull pipe out of a well bore. Pipe push/pull machines include a pair of pipe gripping devices. The pipe gripping devices are mounted on an assembly that maintains the devices in vertical alignment and, while the bottom pipe gripping device is held stationary, moves the upper pipe gripping device vertically toward and away from the lower pipe gripping device. The pipe gripping devices each carry slip members that can be alternately engaged with and released from a pipe being pushed into or pulled from the well.

Pipe gripping devices are known which include a plurality of radially moveable carrier blocks on which slip members are mounted. The slip members can be shifted radially inwardly by the movement of the carrier blocks until teeth on the inner surfaces of the slips engage against the outer surface of a pipe passing through the center of the pipe gripping device. The slip members normally are centered with respect to the horizontal axis of the carrier blocks and are moveably retained in slots in the carrier blocks. Each slot has a pair of wedged surfaces that are co-operable with companion wedged surfaces on the slip member in a manner such that any vertical movement of the slip over the wedged surfaces of the carrier block will drive the slip radially inwardly or outwardly relative to the center of the pipe gripping device. The wedged surfaces are arranged in opposition such that the slip drives radially inward when pushing or pulling pipes with the pipe gripping device.

The carrier blocks are moved by use of spiral gear plates which engage teeth formed in the upper and lower surfaces of the carrier blocks.

However, previous devices have no safety systems to prevent release of pipe which is subject to substantial longitudinal force, such force being due to string weight or high well head pressure.

In addition, when the carrier blocks of previous devices are withdraw radially away from pipe gripping position, they tend to lock against the outer wall of the housing. This locking is caused by the carrier blocks loading against and, thereby, locking against the outer wall. The inertia in the movement of the carrier blocks causes the force of their impact against the housing to be greater than the force which can be exerted by the motor to move the carrier blocks radially inward. The only solution to such jamming has been to increase the size of the drive means. This solution is undesirable as it increases both the cost, as well as the size and the portability of the pipe gripping devices.

Increased use of underbalanced drilling (UBD) technology, where most wells are designed and operated to maintain less than 100 psi in the annulus at surface, has created the need for pipe handling devices able to operate in both the pipe heavy and pipe light conditions and which are able to withstand the forces placed upon them without jamming or binding. Increased use has also required that safety concerns be addressed while the industry has demanded smaller, more portable devices.

SUMMARY OF THE INVENTION

A pipe gripping device for use in a pipe push/pull machine is disclosed which can withstand the rigors of underbalanced drilling without undesirable lock ups. The pipe gripping device is of compact size and is of reasonable cost. In preferred embodiments, the pipe gripping device is selected to prevent inadvertent release of a pipe while the pipe has applied thereto a force against which the device is intended to act.

According to a broad aspect of the present invention, there is provided a gripping device for releasably engaging an elongate member, the gripping device comprising a housing including an upper wall, a lower wall, a side wall and a central opening for accepting an elongate member therethrough; a plurality of slip carrier blocks spaced circumferentially about the opening between the upper wall and the lower wall, each slip carrier block having a rear surface and a sloping front face, the sloping front faces together forming a slip bowl bore with a diameter and the slip carrier blocks each being radially moveable between a fully retracted position and an advanced position to adjust the diameter of the bore; a slip slidably mounted on each sloping front face to move over the front face; a motor to drive the movement of the slip carrier blocks; and a deceleration means for slowing the carrier blocks before the rear surfaces of the carrier blocks come into contact with the side wall of the housing.

By slowing the carrier blocks prior to their contact with the housing side wall, lock up of the carrier blocks against the housing is avoided. The deceleration means can be, for example, a switch which acts to slow the movement of the carrier blocks by slowing the motor. Alternately, the device can include a stop means which acts to stop the carrier blocks before they come into contact with the housing side wall such that a gap is formed between the carrier blocks and the housing side wall when the carrier blocks are in the fully retracted position. The stop means can be any suitable structure or system for limiting the radial outward movement of the carrier blocks. In one embodiment, the deceleration means and the stop means are combined as a switch which senses the proximity of the rear surface of at least one carrier block to the side wall and acts to stop the motor when the rear surface of the carrier block is a selected distance from the side wall.

According to a further broad aspect of the present invention, there is provided a pipe gripping device for releasably engaging a pipe, the pipe gripping device comprising a housing including a central opening for accepting a pipe therethrough, the central opening extending along an axis; a first gripping assembly and a second gripping assembly mounted within the housing, the first gripping assembly including a plurality of slip carrier blocks spaced circumferentially about the opening, each slip carrier block having a rear surface and a sloping front face, the sloping front faces together forming a slip bowl bore with a diameter and the slip carrier blocks each being radially moveable between a fully retracted position and an advanced position to adjust the diameter of the bore; a slip slidably mounted on each sloping front face to move over the front face and the second gripping assembly including a plurality of slip carrier blocks spaced circumferentially about the opening, each slip carrier block having a rear surface and a sloping front face, the sloping front faces together forming a slip bowl bore with a diameter and the slip carrier blocks each being radially moveable between a fully retracted position and an advanced position to adjust the diameter of the bore; a slip slidably mounted on each sloping front face to move over the front face; the slip bowl bore of the first gripping assembly being tapered in a direction substantially parallel with the axis of the central opening and the slip bowl bore of the second gripping assembly being tapered in a direction opposite the first gripping assembly and the slip carrier blocks of the first gripping assembly being radially moveable independent of the slip carrier blocks of the second gripping assembly, such that pipes having applied thereto a substantially axially directed upward force, relative to the opening, can be selectively gripped by the first gripping assembly and pipes having applied thereto a substantially axially directed downward force, relative to the opening, can be selectively gripped by the second gripping assembly.

According to a broad aspect of the present invention, there is provided a gripping device for releasably engaging an elongate member, the gripping device comprising a housing including a central opening for accepting an elongate member therethrough; a plurality of slip carrier blocks spaced circumferentially about the opening, each slip carrier block having a rear surface and a sloping front face, the sloping front faces together forming a slip bowl bore with a diameter and the slip carrier blocks each being radially moveable between a fully retracted position and an advanced position to adjust the diameter of the bore; a slip mounted on each sloping front face to move over the front face, the slips being selected to engage the elongate member and to be slidable along the slope of the front face into a loaded position; and a motor to drive the movement of the slip carrier blocks, the motor being selected to exert a driving force on the slip carrier blocks which is insufficient to permit the carrier blocks to move radially outwardly when the slips are in the loaded position.

By providing a motor which will lock up when the slips are in the loaded position (i.e. acting against a substantially axial force applied to the pipe) inadvertent release of a pipe which has applied thereto at least a selected one of an upward or a downward force is avoided. This provides greater safety in operation of the device over prior art devices, as the forces on the elongate member must be substantially neutral before the carrier blocks can be retracted to withdraw the slips from engagement with the elongate member. In a preferred embodiment, the gripping device according to this aspect of the present invention includes independently actuatable first and second gripping assemblies, the first gripping assembly being selected to act against upwardly directed forces on the elongate member and the second gripping assembly being selected to act against downwardly directed forces on the elongate member.

According to another broad aspect of the present invention there is provided a machine for moving pipes into or out of a well comprising a first pipe gripping device and a second pipe gripping device, the first pipe gripping device disposed stationary in vertical elevation and the second pipe gripping device being vertically moveable relative to the first pipe gripping device, the second pipe gripping device being slidably engaged to a substantially vertical track and moving means for moving the second pipe gripping device along the track, each pipe engaging device including a housing including an upper wall, a lower wall a side wall and a central opening for accepting an elongate member therethrough; a plurality of slip carrier blocks spaced circumferentially about the opening between the upper wall and the lower wall, each slip carrier block having a rear surface and a sloping front face, the sloping front faces together forming a slip bowl bore with a diameter and the slip carrier blocks each being radially moveable between a fully retracted position and an advanced position to adjust the diameter of the bore; a slip slidably mounted on each sloping front face to move over the front face; a motor to drive the movement of the slip carrier blocks. The machine includes at least one of the improvements comprising: a carrier block deceleration means; a carrier block stop means; a first gripping assembly and a second independently actuatable gripping assembly in each device; and the motor being selected to exert a driving force on the slip carrier blocks which is insufficient to permit the carrier blocks to move radially outwardly when the slips are in the loaded position. The machine need only include one of the improvements, but can include more than one improvement, as desired.

Preferably, the moving means is a chain drive for pulling the second pipe gripping device upwardly along the track and, more preferably, there is also a second chain drive for pulling the second pipe gripping device downwardly along the track. Preferably, the means for driving the chain drive is a hydraulic cylinder, more preferably connected to drive both chain drives.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIGS. 9A to 9C are side elevation views of a cylinder sheathe of a pipe/pull machine.

DESCRIPTION OF THE PREFERRED EMBODIMENTS OF THE INVENTION

Figure 1A:
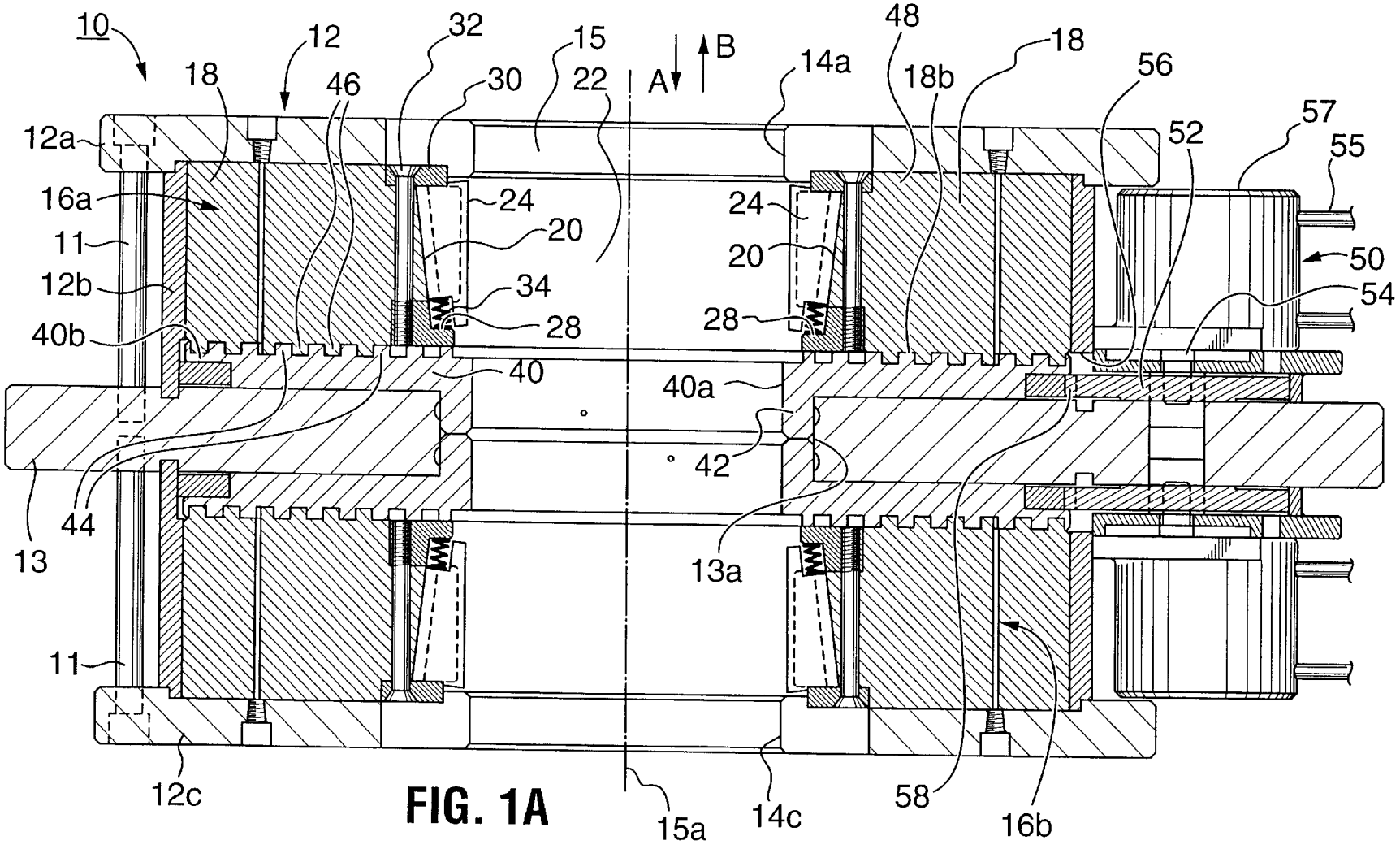
FIG. 1A is a vertical section through a pipe gripping device according to the present invention.
Figure 1B:
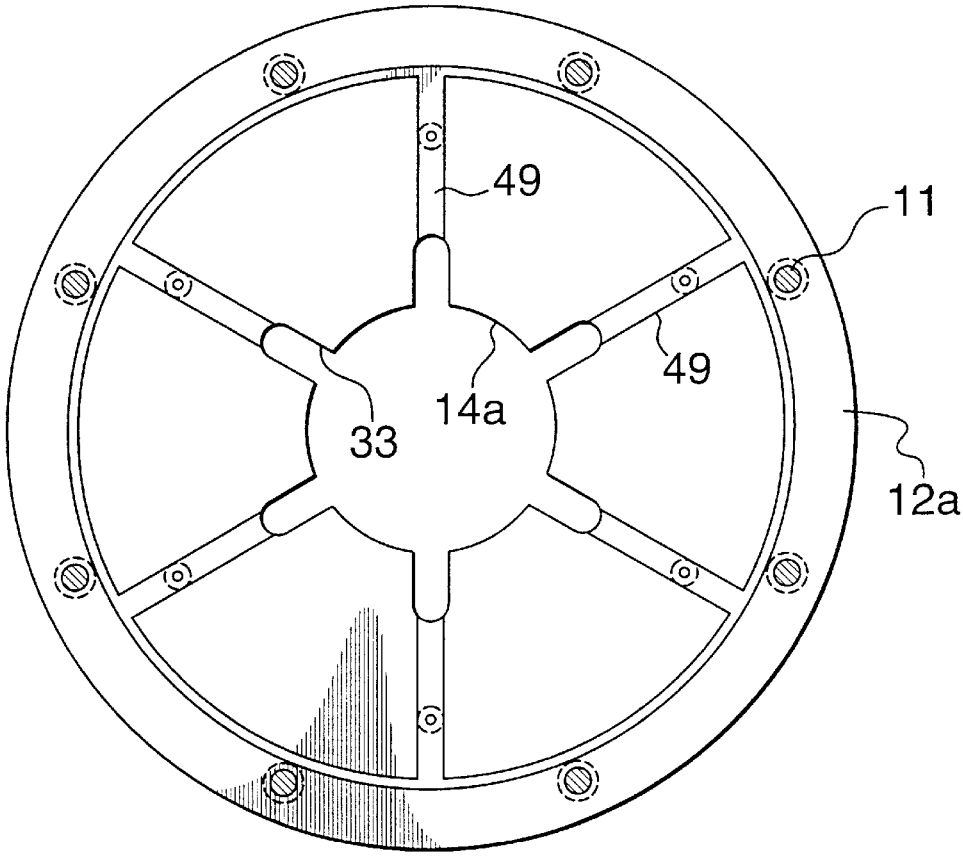
FIG. 1B is a plan view of the top housing section of the device of FIG. 1A showing its inner facing side.
Figure 2:
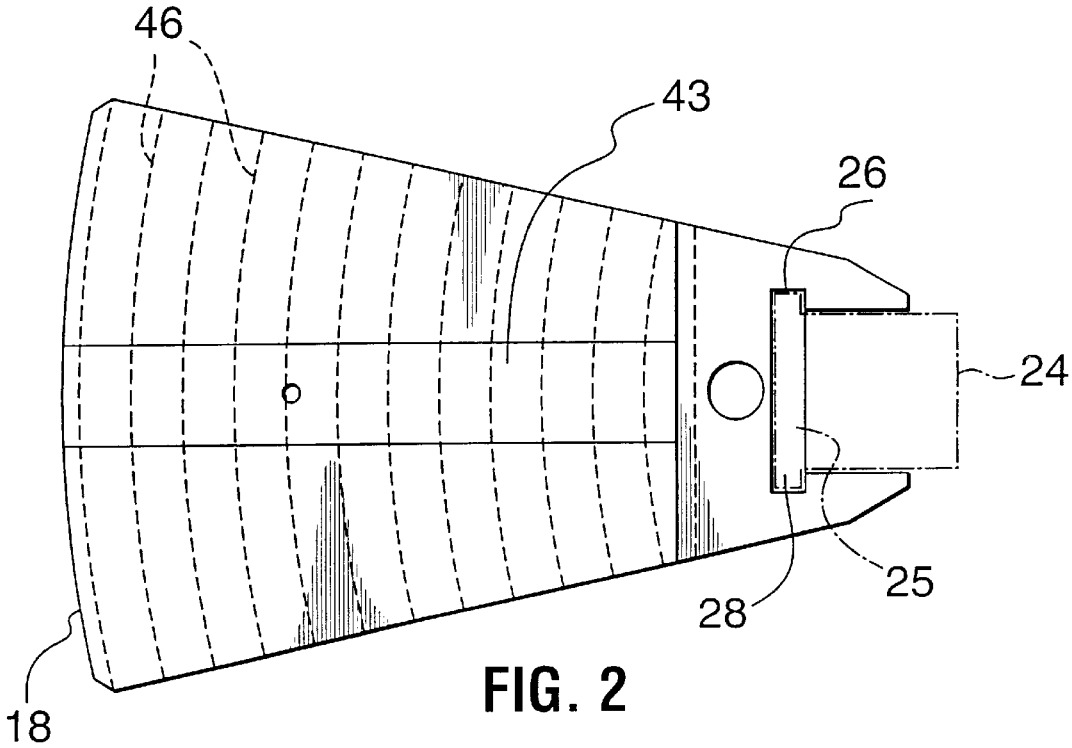
FIG. 2 is a top plan view of a carrier block useful in the device of FIG. 1A.

Referring to FIGS. 1A to 4, a pipe gripping device according to the present invention is generally indicated at 10. A pipe gripping device, as shown, is useful in a pipe push/pull machine. Oil wells, such as underbalanced wells, require pipe gripping devices which are dual acting and can handle pipe in either a pipe heavy condition, wherein the major force on the pipe is toward the bottom of the well bore, or a pipe light condition, wherein the major force on the pipe is tending to push the pipe out of the well bore.

Pipe gripping device 10 includes a housing 12 having an upper section 12*a*, a middle cylindrical section 12*b* and a lower section 12*c*. The sections of the housing are held together by bolts 11 which extend from the upper section and the lower section and thread into the middle section. Upper section 12*a* and lower section 12*c* are plates mounted in substantially parallel planes. The middle housing includes a middle plate 13 extending substantially parallel to upper housing section 12*a*. Upper section 12*a*, lower section 12*c* and middle plate 13 have aligned openings 14*a*, 14*c*, 13*a* which define a central bore 15 through the unit. The diameters of the openings are selected to be larger than the diameter of the largest pipe or tool to be handled by or passed through the device.

Within the housing 12 are disposed an upper gripping assembly 16*a* and a lower gripping assembly 16*b*. Middle plate 13 separates upper gripping assembly 16*a* from lower gripping assembly 16*b*. The gripping assemblies 16*a*, 16*b* are identical in construction except that they are symmetrical about middle plate 13. In other words, lower gripping assembly 16*b* is identical to upper gripping assembly 16*a*, except it is in an upside down configuration. This permits gripping assembly 16*a* to accommodate forces which are directed substantially along line A which would be a pipe heavy condition, while gripping assembly 16*b* accommodates forces which are directed substantially along line B or, for example, a pipe light condition. The upper gripping assembly and the lower gripping assembly can be selected, where desired, so that the upper gripping assembly 16*a* is selected to grip pipe in the pipe light condition and lower gripping assembly is selected to grip pipe in the pipe heavy condition.

Gripping assembly construction will be further described by reference to assembly 16*a*. Each gripping assembly includes a plurality of slip carrier blocks 18. Any number of carrier blocks can be accommodated by adjusting the size of the carrier blocks. However, four or six carrier blocks, as shown, are preferred and have been found useful for a wide range of pipe diameters. The carrier blocks are circumferentially spaced apart about the central bore 15 and are moveable towards and away from its central axis, indicated at 15*a*. Carrier blocks 18 are moveable by any suitable moving means, but preferably by a spiral gear drive as will be described hereinafter. Carrier blocks 18 are preferably generally wedge-shaped in plan view to permit them to fit together as they are moved towards the central axis 15*a*. Forming the carrier blocks as wedges permits increased slip capacity. In particular, as the load on the slips is increased, the engaging force which is directed toward axis 15*a* is increased. Therefore, all forces placed on the slips and the carrier blocks is concentrated through the reduced surface area at the tapered end of the block.

The carrier blocks 18 are each similar in construction, each having a sloping front face 20. Together, the faces 20 of the carrier blocks in each gripping assembly define therebetween a downwardly and inwardly tapering conical slip bowl bore 22.

Sloping front face 20 of each carrier block 18 has slidably mounted thereon a pipe gripping slip 24. Pipe gripping slip 24 has a dove tail key 25 which is keyed into a dove tail groove 26 formed on face 20 and extending from the top 18*a* toward the bottom 18*b* of the carrier block. Slip 24 can slide along the sloping front face 20, as limited by engagement of key 25 in groove 26. End wall 28 is provided to prevent slip 24 from sliding out of engagement with groove. At the upper end of groove 26, a removable stop flange 30 is secured by means of a fastener 32, such as a bolt, to prevent upward movement of slip 24 out of engagement with groove 26. Preferably, the upper and the lower housing sections have provided therein an opening 33 at each carrier block position through which access is provided to stop flange 30 and fastener 32 to facilitate replacement or repair of the slips without disassembly of the housing. Slip 24 is slidably moveable in groove but is biased against stop flange 30 by a coil spring 34 acting between the carrier block and the slip. The exposed faces of slips 24 are preferably roughened or formed with teeth to increase their engagement characteristics.

The slips 24 can be moved along their grooves against the tension in spring 34 by application of force thereto. Each slip is arranged on the sloping front face of its carrier block so that when substantially no force is applied to the face thereof, the slip will be biased by spring 34 into an unloaded position. When an appropriately directed force is applied against the face of the slip, it moves against the tension in spring 34 toward the tapered end of the slip bowl bore and is considered to be loaded. In use, the force on the slip is generally applied by an elongate member having applied thereto an axially directed load.

Each carrier block 18 is radially moveable toward and away from axis 15*a* preferably by a gear drive assembly including a spiral gear plate 40. Spiral gear plate 40 is an annular ring disposed between the carrier blocks 18 and the middle plate 13 in each gripping assembly. Plate 40 includes a central opening 40*a* and an annular flange 42 disposed thereabout. Flange 42 is formed to fit within opening 13*a* of middle plate 13 such that spiral ring plate 40 can rotate about the central axis 15*a* of bore 15 using middle plate 13 as a bushing. A bushing liner material can be provided about bore 15 of middle plate 13 to facilitate rotation of flange 42 in bore 15.

Spiral gear plate 40 has a plurality of elongate teeth 44 which spiral inwardly from the plate's outer edge 40*b* toward opening 40*a*. Teeth 44 are formed to enmesh with a plurality of curved elongate teeth 46 formed on bottom 18*b* of each carrier block 18 and which extend between the sides of the carrier block. Within housing 12, curved elongate teeth 46 of carrier blocks 18 are forced into and are maintained in engagement with the spiral teeth 44 of spiral plate 40 by upper housing section 12*a*. Carrier blocks 18 have raised keys 48 on their top surfaces which fit into radially extending slots 49 formed in housing sections 12*a*, 12*c*. Keys 48 engage in slots 49 and limit the carrier blocks to radial movement in housing 12.

As would be understood by a person skilled in the art, the teeth 46 on each carrier block 18 must be selected to correspond to the teeth 44 on the section of the spiral gear plate over which that carrier block is selected to move. As an example, the carrier blocks can be formed by forming the gear plate first and then forming a second plate of greater thickness corresponding to the thickness of the carrier blocks. The second plate is formed to have the identical but reverse hand spiral arrangement of teeth as the first plate. The second plate is then cut into sections, representing carrier blocks. The carrier blocks are coded to identify the section of the first spiral plate over which they will fit. As would also be appreciated, the curvature of the teeth of the gear plate 40 will increase as the teeth spiral inwardly. Thus, the curvature of the carrier block teeth 46 must be selected such that the teeth 46 mesh with both teeth 44 at the outer edge of the plate and teeth 44, having a tighter curvature, at the inner edge of the plate without binding.

Rotation of plate 40 causes teeth 44 to drive against teeth 46 of carrier blocks 18 and thereby to drive carrier blocks radially inward or outward, depending on the direction of the rotational movement of the plate 40. Teeth 46 are selectively formed on each carrier block such that each carrier block has its own position on the gear plate 40 relative to the other carrier blocks. Carrier block teeth 46 and teeth 44 on the plate are formed such that each carrier block in the gripping assembly moves at the same rate when driven. Preferably lubricants are provided between the carrier blocks and the spiral plate to facilitate relative movement of the parts.

Plate 40 is preferably rotatably driven by a hydraulically actuated gear drive, generally indicated at 50. Gear drive 50 includes a gear wheel 52 connected to a hydraulically driven axle 54, as is known. Hydraulic lines 55 provide hydraulic fluid to a hydraulic motor 57 for driving the axle. Gear wheel 52 extends through an opening 56 in housing 12 and has teeth at its outer edge which engage teeth 58 formed on the outer edge 40*b* of plate 40.

Each of the upper gripping assembly and the lower gripping assembly have their own spiral gear plate 40 and gear drive 50. The gear drives 50 are controlled and actuated separately such that the carrier blocks of the upper and lower assembly can be radially driven separately to grip or release a pipe.

To increase the safety of the pipe gripping device, each gripping assembly is selected such that the carrier blocks cannot be withdrawn from pipe gripping position when the slips are loaded. When slips 24 are loaded, the force on the slips tends to drive the carrier blocks into firm engagement with the adjacent parts. For example, in the illustrated device when the slips of gripping assembly 16*a* are loaded (i.e. by application of forces to slips 24 which are directed substantially along line A), forces will be transferred to carrier blocks 18 which will tend to drive teeth 46 into greater engagement with teeth 44. To prevent carrier blocks from being withdrawn from pipe gripping position when the slips are loaded, motor 57 is preferably selected to be of insufficient power to overcome the frictional engagement force of the carrier blocks, for example teeth 46, with the adjacent parts, for example teeth 44, when the slips are in the loaded position. This prevents the slips from being retracted from pipe gripping position while there remains force on the pipe. For use in underbalanced drilling, a suitable motor for a four carrier block pipe gripping device according to the present invention is, for example, a hydraulic drive motor of between about 17 to 23 hp.

Figure 3A:
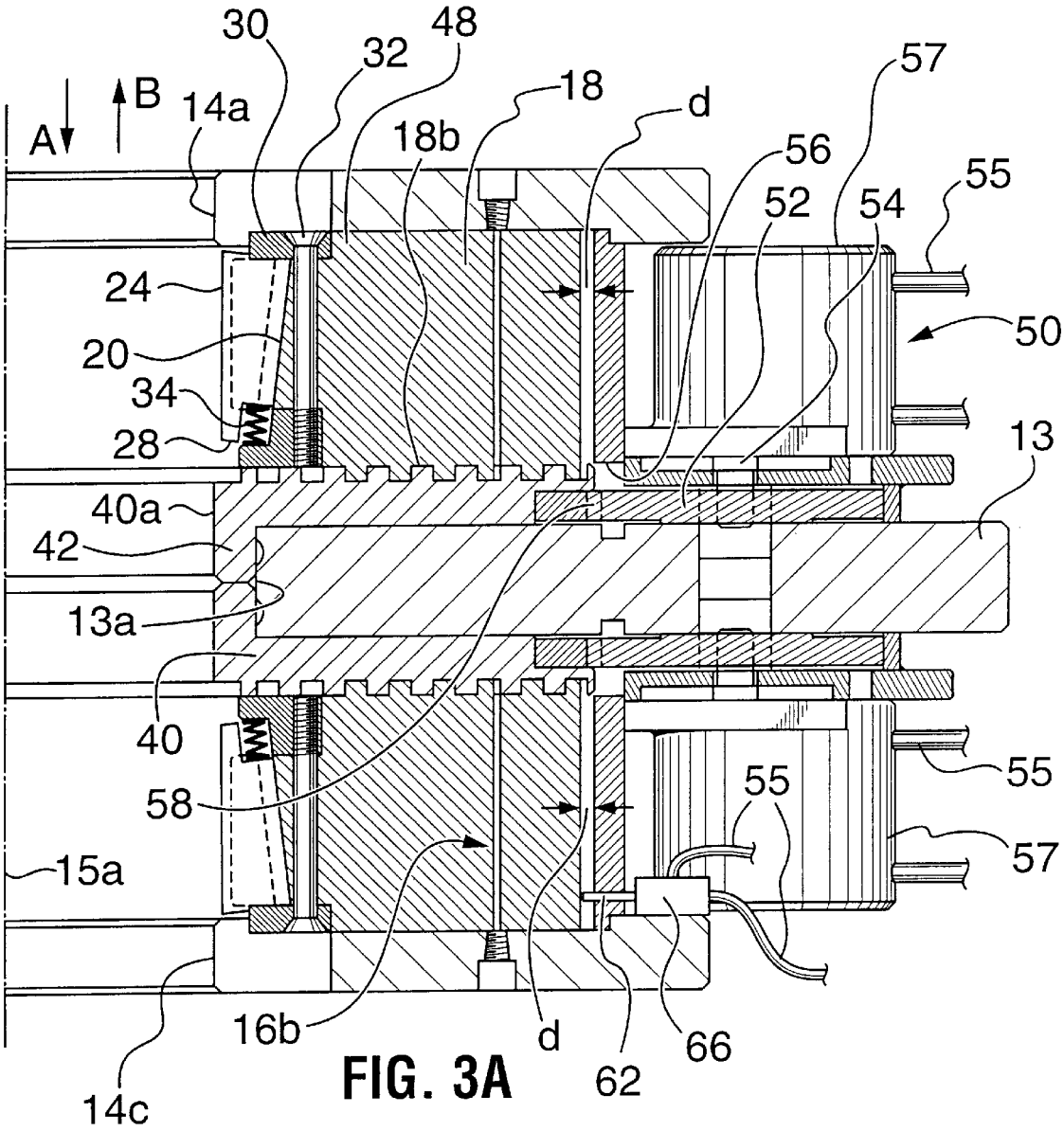
FIG. 3A is a partial vertical section through another pipe gripping device according to the present invention.
Figure 3B:
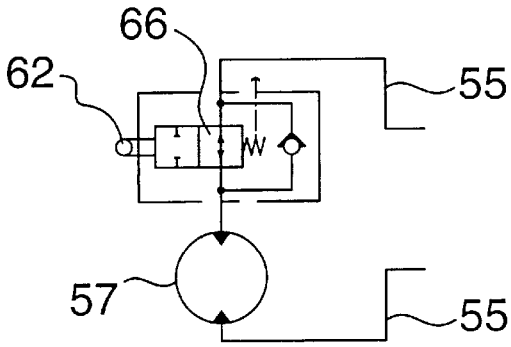
FIG. 3B is a circuit schematic of a hydraulic fluid control system useful in the present invention.

In another embodiment, as shown in FIGS. 3A and 3B, gear drive 50 is modified to prevent lock up of the carrier blocks against middle cylindrical section 12*b* of the housing. Preferably, a pressure sensing switch 62 is mounted within the housing in a position behind at least one carrier block. Switch 62 is selected such that it will be actuated when a carrier block is moved within a selected distance, d, from middle cylindrical section 12*b*. Distance d is selected to be sufficient to prevent the lock up of the carrier blocks against the middle cylindrical section. The switch is in controlling communication via line 64 with a valve 66. Valve 66 is positioned to control the flow of hydraulic fluid through line 55 and thereby to control the operation of motor 57. When a carrier block moves to distance d from middle cylindrical housing 12*b*, switch 62 is actuated to close valve 66. When valve 66 is closed, the flow of hydraulic fluid is cut off to motor 57. This stops the operation of motor 57 and, therefore, slows and stops the carrier block. Only one switch is required for each gripping assembly, as the carrier blocks in each gripping assembly move in unison. A useful valve is, for example, a deceleration valve such as the model DC600S deceleration valve available from Parker Fluidpower Inc. In one embodiment, the device is selected such that a gap of about 1/16" remains between the carrier blocks and the middle cylindrical housing 12*b* when the carrier blocks are fully retracted. In another embodiment, the deceleration valve is selected to slow the carrier blocks before they come into contact with the middle cylindrical housing. In this embodiment, the carrier blocks are slowed to speed which is low enough to prevent lock-up of the carrier blocks against the housing, with consideration as to the power of the motor driving the radial inward movement of the carrier blocks.

Figure 4:
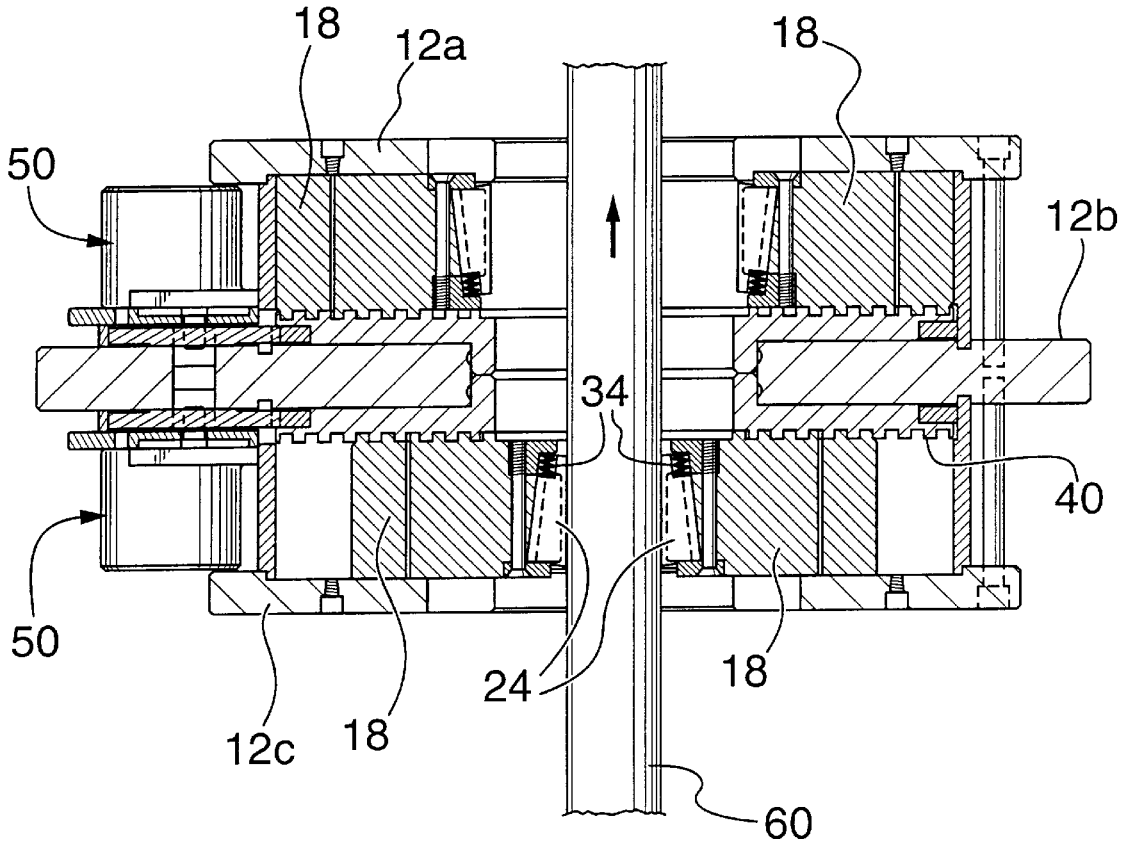
FIG. 4 is a vertical section through a pipe gripping device according to the present invention.

In operation, pipe gripping device 10 is used on a pipe push/pull machine or the like to grip and drive a pipe into or out of the well bore. An upper pipe gripping device and a lower pipe gripping device are used. The upper pipe gripping device is disposed above the lower pipe gripping device such that their central bores are aligned. The lower unit remains stationary while the upper unit cycles from an upper position to a lower position. The pipe to be driven may be either pipe heavy or pipe light. Referring to FIG. 4, the pipe 60 as shown is pipe light. This means that the major forces on the pipe are tending to drive the pipe upwardly or out of the well bore. To grip the pipe, hydraulic lines 55 are connected to a source of hydraulic fluid and the gear drive is connected to a control station where an operator can manipulate motor 57 and the movement of the gripping devices on the pipe push/pull machine, if desired. Gear drive 50 is driven such that gear wheel 52 rotates and, thereby, rotates plate 40. As plate 40 is rotated in a selected direction, teeth 44 of plate 40 engage against teeth 46 of carrier blocks 18 and carrier blocks 18 are driven radially inwards toward the central bore 15. When slips 24 engage pipe 60, the upward force of the pipe will drive the slip along groove 26 against the tension of spring 34 into a loaded position. This causes the slips 24 to be driven into greater engagement with the pipe, due to the movement of slips 24 along the sloped face of the carrier blocks and into the tapering portion of the slip bowl bore. Slip 24 will be driven along groove 26 until the slip is wedged between the pipe and the sloped face of the carrier block. This acts to firmly grip the pipe and overcomes the force tending to drive the pipe upwardly. When motor 57 is stopped, it is hydraulically locked so that carrier blocks 18 cannot move either radially inwardly or radially outwardly. The pipe can then be rotated and/or driven vertically by the pipe gripping device. The housing can be fitted with a bearing assembly that will allow the unit to rotate while axial forces are applied thereto.

Preferably, the slips and the sloping faces of the carrier blocks are formed such that they will act against a force in one direction only (i.e. only one of pipe light or pipe heavy force). Such a slip arrangement permits easier determination as to when the slips are unloaded and increases the safety of the pipe gripping device over prior art devices with dual acting slips.

In a standard drilling operation, wherein the majority of the forces acting on the pipe to be inserted into the well bore are directed downward into the well bore, the slips of the present invention can be modified by removing the pipe light gripping assembly.

Figure 5:
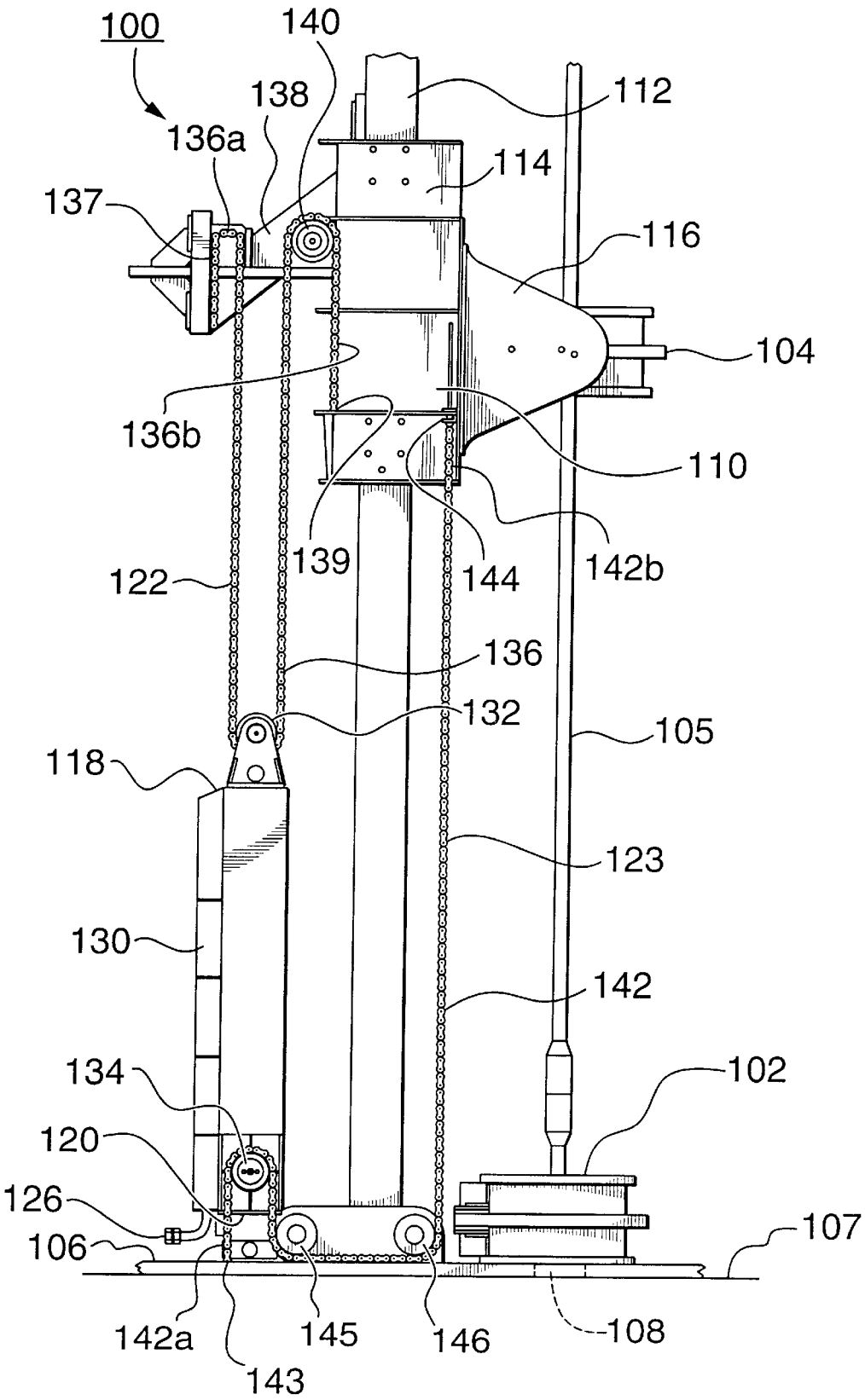
FIG. 5 is a side elevation view of a pipe push/pull machine useful with the pipe gripping devices according to the present invention.

Referring to FIG. 5, a pipe push/pull machine, generally indicated at 100, is shown which is particularly useful with the pipe gripping means according to the present invention. The machine can snub bottom hole assemblies (BHA's) into wells. The machine drives a pair of pipe gripping devices 102, 104 which are, for example, as shown in FIG. 1A or FIG. 3. As has been described hereinbefore, the lower pipe gripping device 102 is stationary, while the upper pipe gripping device 104 is disposed to travel vertically above pipe gripping device 102, as driven by machine 100. Machine 100 drives pipe gripping device 104 up and down in a continuous cycle to grip a pipe 105 and either drive it into or withdraw it from a well bore.

The machine includes a base plate 106 on which the other parts are mounted. This facilitates portability, installation and transport of the machine. Alternately, the machine can be mounted directly on to a rig floor 107. In any event the machine is placed adjacent the rig floor opening 108 to the well bore.

Machine 100 includes a traveling assembly 110 which supports upper pipe gripping device 104. Traveling assembly 110 is moveably engaged to and rides along a substantially vertically oriented track 112. Track 112 is mounted on the base plate 106 and extends substantially vertically along a length suitable for accommodating the required vertical travel of the upper pipe gripping device. Preferably, the track is of box-section and is substantially rigid. In one embodiment, the track is secured directly to the rig floor rather than a base plate. Any connection must be suitable for accommodating the downward force which will be conducted through the track to the base to which it is secured.

Figure 6:
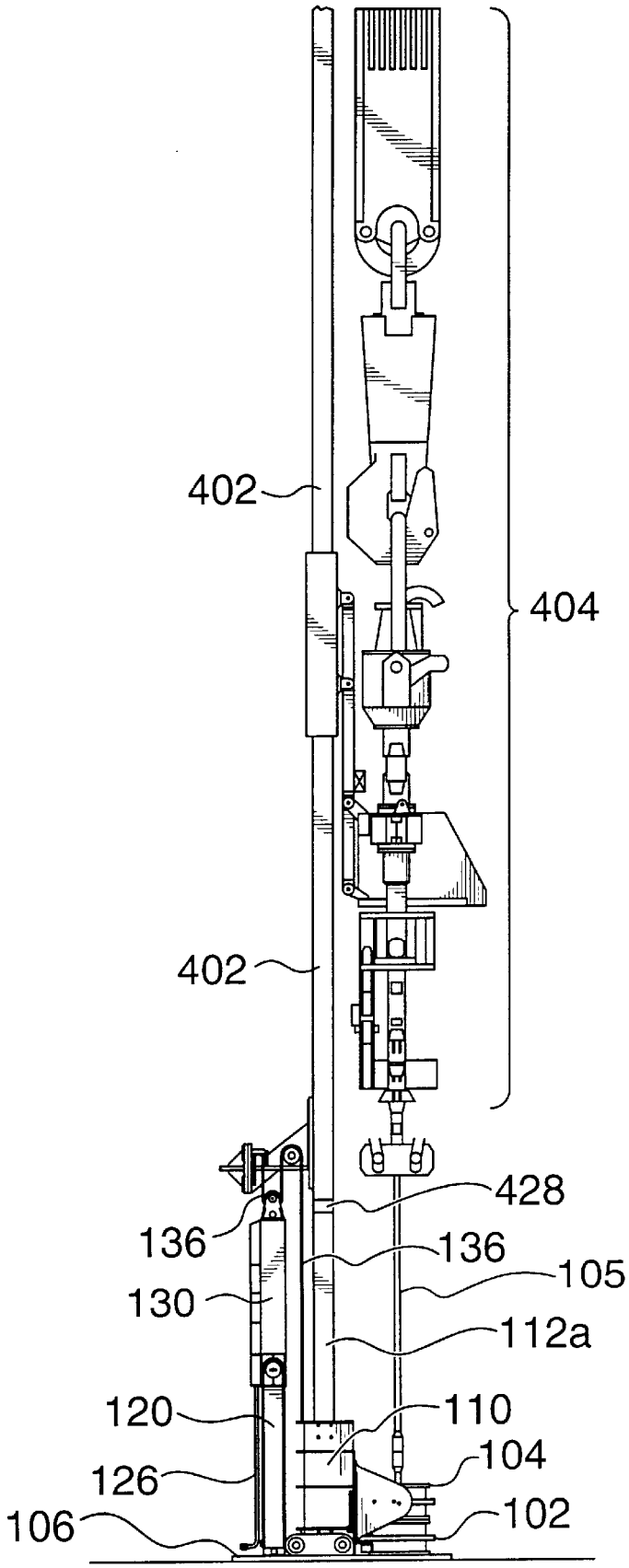
FIG. 6 is a side elevation view the machine of FIG. 5 also showing a top drive drilling assembly useful with the present invention.
Figure 7:
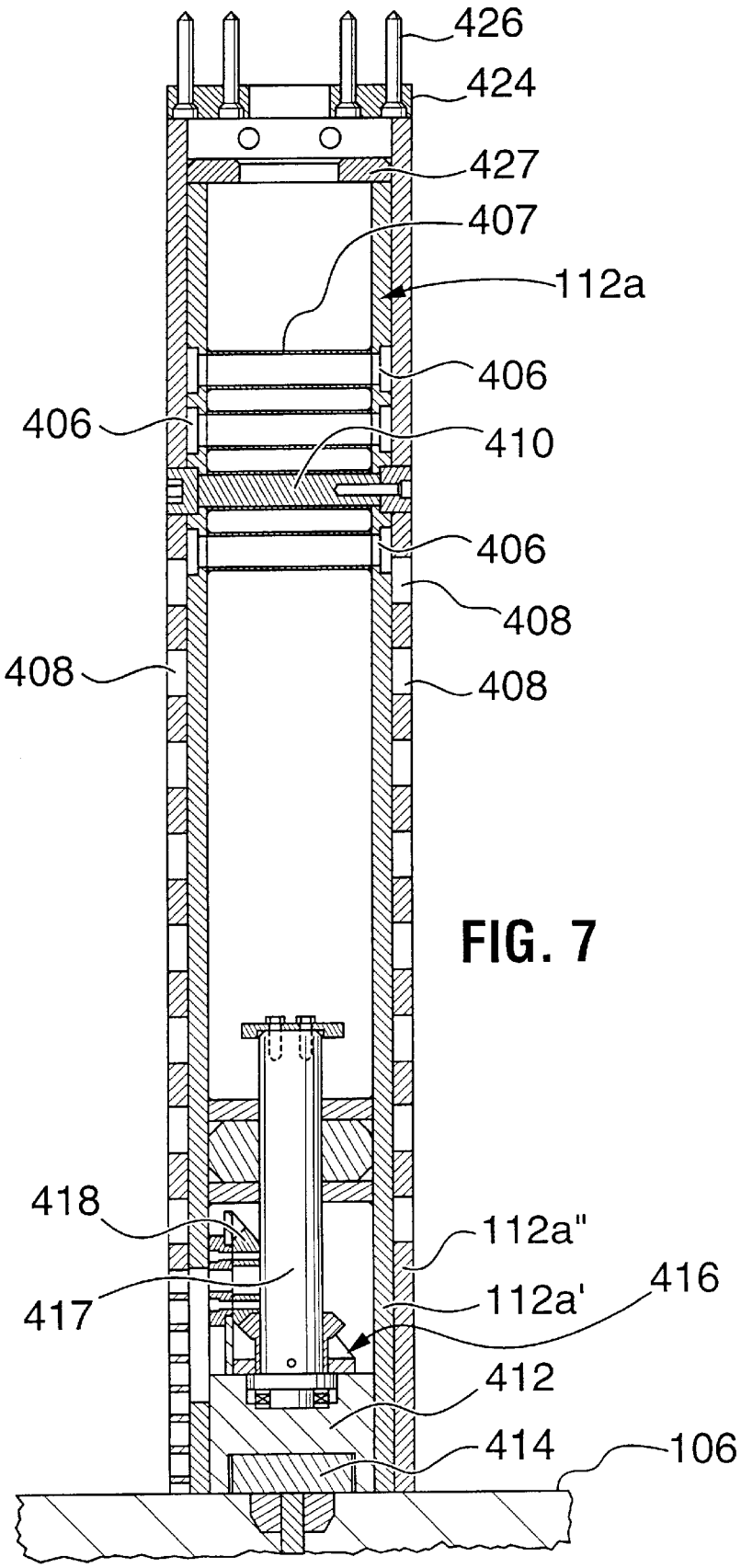
FIG. 7 is a vertical section through an extendable post useful for mounting a pipe push/pull machine.
Figure 8:
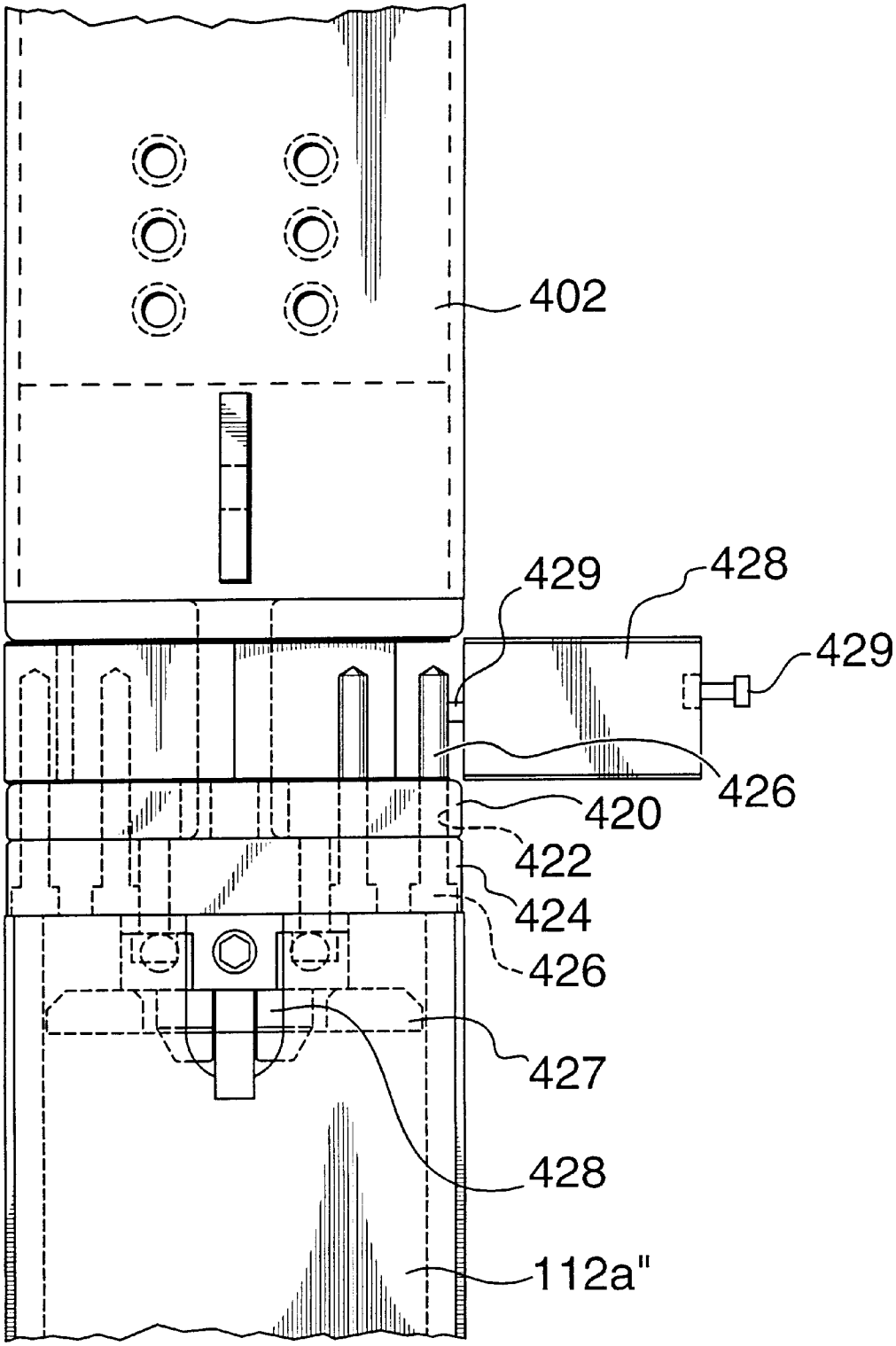
FIG. 8 is a side elevation view of a top portion of the post of FIG. 7 attached to a torque track of a top drive drilling assembly.
Figure 10:
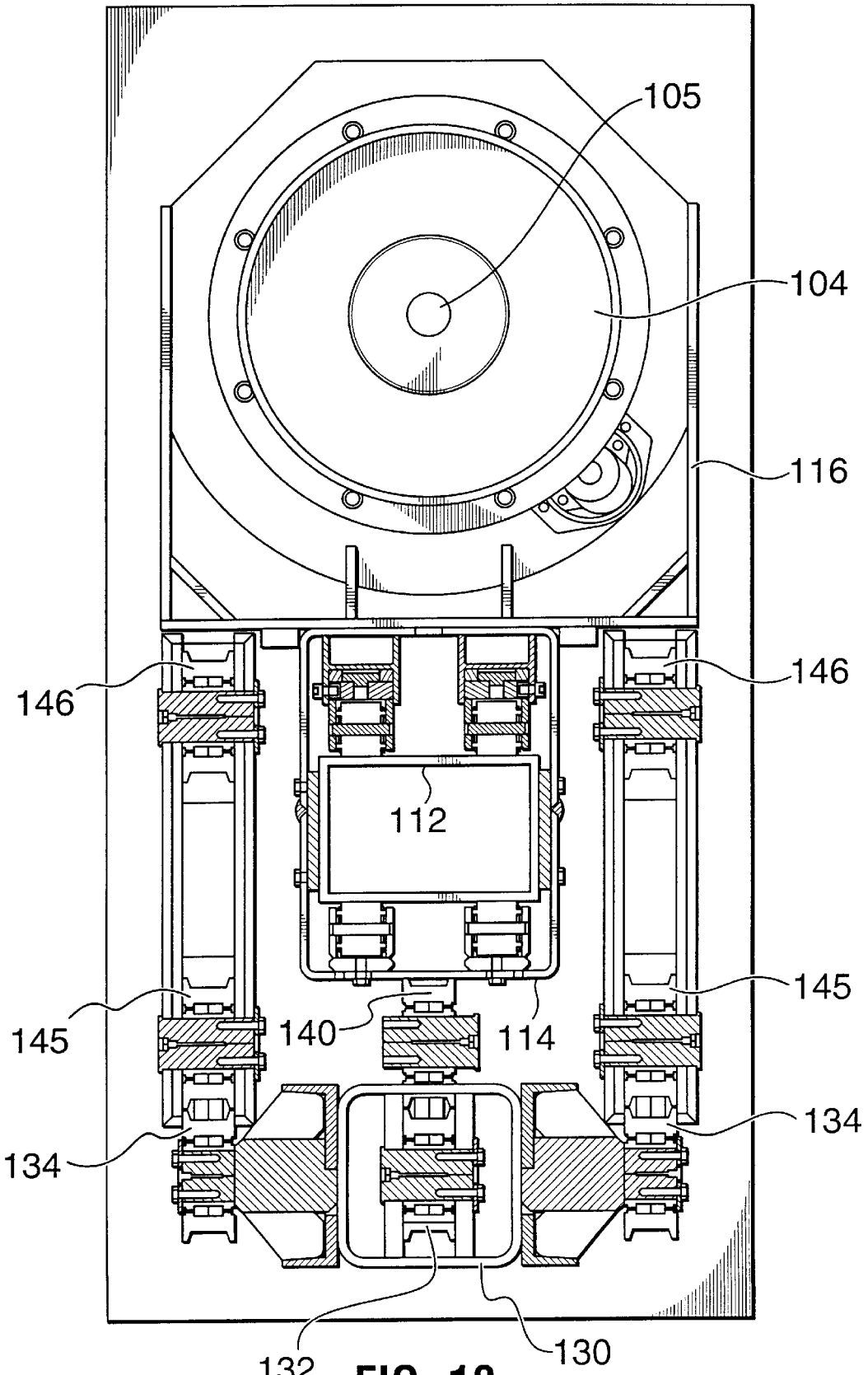
FIG. 10 is a top plan view of the machine of FIG. 5.

In one embodiment, the track is an extension of a top drive drilling torque track as is described for example in U.S. Pat. No. 5,433,279 of Tesco Corporation. With reference to FIGS. 6 to 8, a track 112*a* is provided according to the present invention which can be fit together with a top drive drilling torque track 402 of a top drive drilling assembly 404. Track 112*a* is extendable to various lengths to facilitate attachment to preexisting top drive assemblies which, as will be appreciated, can be suspended at various heights above the rig floor. Track 112*a* has a lower section 112*a*' and an upper section 112*a*" fitted telescopically over the lower section. (Of course, it is to be understood that the sections could be reversed so that section 112*a*' fits telescopically over section 112*a*") Section 112*a*' has a plurality of apertures 406 formed along its sides which are aligned in pairs. Preferably, between each pair of apertures is secured a conduit 407. Likewise, section 112*a*" also has a plurality of apertures 408 formed along its sides which are aligned in pairs. Apertures 406 and 408 are formed on their sections, such that when section 112*a*" is moved over section 11 2*a*', at least one pair of each set of apertures will align and permit the insertion therethrough of a pin 410, such as a bolt, which will act to lock section 112*a*" in position along section 112*a* '. Preferably, apertures 406 and apertures 408 are vemiered relative to each other to permit finer control over the length of the extended track.

A connector 412 is secured at the lower end of section 112*a*' for connection to a cooperating connector 414 on base plate 106. Preferably connectors 412, 414 are sections of a tandem lock, as is known, or another similar lock arrangement. Preferably, a screw drive 416, having an elongate screw 417 driven by gear 418, is connected between connector 412 and section 112*a*' to permit vertical adjustment of section 112*a*'. In particular, screw 417 is rotatably mounted on connector 412 and engaged in a threaded nut 419 secured within the bore of section 112*a*'. Gear 418 is enmeshed with a toothed gear 419 formed about screw 417. Turning of gear 418 by, for example, a wrench, causes rotation of screw which drives nut and adjusts the vertical position of section 112*a*'. Section 112*a*" is formed at its upper end for connection to torque track 402. Torque track 402, produced by Tesco Corporation, has at its end an inset flange 420 having bolt holes 422 therethrough. Section 112*a*" has mounted at its end a plate 424 with studs 426 secured thereto and extending therefrom. Studs 426 are secured through holes 422 to connect section 112*a*" to track 402. Preferably also a female connector 427 is mounted at the end of section 112" which accepts and locks an extension 428 on track 402. To facilitate movement of traveling assembly over the connection, two C-shaped plates 428 are fit over the connection and are secured thereover by screws 429. After securing plates 428, a flush surface is provided by section 112*a*", plate 424, plates 428 and track 402 along which the traveling assembly can ride.

Installation of the track 112 onto a rig having a top drive assembly 404 thereon includes securing base plate 106 to the rig floor, as by welding or bolting, such that connector 414 is aligned directly below track 402. The track 112 is moved onto place to mate and lock together, connector 412 on section 112*a*' and connector 414 on base 106. The track is then erect below track 402 and the section 112*a*" is moved along section 1 12*a*' until studs 426 extend through holes 422 of track 402 and then pin 410 is inserted into aligned aperture 406, 408, as facilitated by passage through conduit 407. Where plate 424 is not in abutting engagement with flange 420, vertical adjustment is made by driving gear 418, and thereby screw 417, to move section the track 112 upwardly. Connectors 427, 428 are locked together and plates 428 are then secured over the connection.

The traveling assembly 110 includes a bushing 114 and pipe gripping device support arms 116 (only one support arm can be seen as the other support arm is positioned behind it in the side elevation view). Bushing 114 is tubular and box-like in section. It fits around and is moveable along track 112. Because of their box-like configurations, bushing 114 rigidly engages the track 112 so that it cannot rotate thereon but will transmit reactive loads to it. Stated otherwise, the bushing 114 is not rotatable about the track.

Movement facilitators, such as for example rollers, tracks, linear bearings or high molecular weight liners are provided between bushing 114 and track 112 to facilitate movement of bushing 114 over track 112.

Support arms 116 at their inner ends are rigidly connected and preferably formed integral with bushing 114. At their outer ends, support arms 116 are rigidly connected to pipe gripping device 104. Thus, any movement of bushing 114 along track 112 is translated to vertical movement of pipe gripping device 104 towards or away from pipe gripping device 102.

Referring also to FIGS. 9A to 9C and FIG. 10 machine 100 further includes a linear movement driving means, generally indicated at 118, to drive traveling assembly 110 along track 112. Means 118 includes a hydraulic cylinder 120 connected to drive movement of traveling assembly 110 through at least one and preferably two chain drives 122, 14. Pressurized hydraulic fluid is provided to the cylinder via line 126. Preferably the cylinder is oriented such that pressure is applied to the piston side of the cylinder for downward force pipe gripping device 104 and to the rod side of the piston for returning the pipe gripping device to its highest position. This permits a faster cycle time, over similar cylinder sizes in other orientations, since after the driving stroke, a smaller volume of hydraulic fluid is required to be moved to return the cylinder to position to repeat the driving stroke.

For connection to the chain drive means, elongate piston rod 128 of hydraulic cylinder has mounted thereon a rigid sheathe 130 onto which is mounted a first pulley 132 and a second pulley 134. Sheathe 130 is rigidly attached to piston rod 128 and is moved therewith.

First pulley 132 has engaged thereabout a chain 136 having a fixed length. At its first end 136*a*, chain 136 is anchored at 137, as by welding or the like, to a fixed structure, for example as shown, a support flange 138 extending from track 112. Chain 136, at its second end 136*b* is secured at 139 to the traveling assembly 110. Between pulley 132 and end 136*b*, chain 136 passes over an upper pulley 140 disposed at a higher vertical elevation than the upper limit of movement of the point 139 at which chain 136 is attached to traveling assembly 110.

Movement of piston rod 128 is translated to sheathe 130 and attached pulley 132. Because chain 136 passing over pulley 132 is anchored at end 136*a*, any movement of pulley 132 causes chain 136 to be moved over pulley 140, which thereby causes movement of traveling assembly 110. When the piston rod is driven out of the hydraulic cylinder (i.e. the piston is moved vertically upward), there results a slack in the chain which will allow the traveling assembly 100 to move down on the track 112. This downward movement is preferably driven actively by a second chain drive 14 as will be described herein after. Alternately, the second chain drive 14 can be omitted and the downward movement can be by gravity. FIG. 6 shows the traveling assembly 110 and pipe gripping device 104 at its lower limit of movement.

When the hydraulic cylinder is actuated to draw the piston rod back into the cylinder, chain 136 is acted upon to move the traveling assembly upwardly on the track to return to its upper position on the track (FIG. 5).

As noted hereinbefore, a second chain drive 14 can be used to actively drive the downward movement of the traveling assembly. Second chain drive 14 includes two chains 142, the second chain being disposed out of view behind the first chain in FIG. 5. The chains 142 are symmetrically disposed on the sides of the cylinder to balance the forces imparted thereon. At their first ends 142*a*, chains 142 are anchored at 143 as by welding or the like to a fixed structure, for example the base plate 106. Chains 142, at their opposite ends 142*b*, are secured at 144 as by welding or bolting to the traveling assembly 110. Pulleys 145, 146 are positioned at a lower vertical elevation than point 144 on the traveling assembly and redirect the force on the chains to cause vertical force to be applied to pull traveling assembly downwardly. Again, because chains are anchored at their first ends 142*a*, any movement of second pulley 134 by piston rod 128 will be translated to the traveling assembly.

In this way, traveling assembly 110 and, thereby, pipe gripping device 104 is moved through its vertical cycle to grip and drive pipe 105 into or out of the well.

It is to be understood that the chains can be triple leaved chains or other structures such as wire rope, provided they are suitable for accommodating the force in the system which can be, for example 25,000 psi. It is also to be understood that the pulleys, anchor points and securement points can take other orientations.

It will be apparent that many other changes may be made to the illustrative embodiments, while falling within the scope of the invention and it is intended that all such changes be covered by the claims appended hereto.

What is claimed is:

1. A gripping device for releasably engaging an elongate member, the gripping device comprising:

a housing including an upper wall, a lower wall and a central opening for accepting an elongate member therethrough; a plurality of slip carrier blocks spaced circumferentially about the opening between the upper wall and the lower wall, each slip carrier block having a rear surface and a sloping front face, the sloping front faces together forming a slip bowl bore with a diameter and the slip carrier blocks each being radially moveable between a selected fully retracted position and an advanced position to adjust the diameter of the bore; a slip slidably mounted on each sloping front face to move over the front face; a motor to drive the movement of the slip carrier blocks; and a switch for sensing the proximity of at least one carrier block to the fully retracted position and acting to stop the motor when the carrier block is at about the fully retracted position.

2. The gripping device of claim 1 further comprising a side wall and in the selected fully retracted position the carrier block is spaced from the side wall.

3. The gripping device of claim 1 wherein the motor is hydraulically driven and the switch is in controlling communication with a valve positioned to regulate the flow of hydraulic fluid dribing the motor.

4. The gripping device of claim 1 further comprising a spiral gear plate including an annular gear surface and a central opening through the annular gear surface, the spiral gear plate being positioned such that its central opening corresponds with the central opening of the housing and the annular gear surface is in engaging contact with the slip carrier blocks, the annular gear surface having formed thereon elongate gear teeth spiraling inwardly toward the central opening and a wherein the slip carrier blocks each include a plurality of curved gear teeth formed on a surface contacting the spiral gear plate and selected to mesh with the elongate gear teeth of the spiral gear plate, the spiral gear plate being rotatable about the central opening to drive the slip carrier blocks radially by the elongate gear teeth acting against the curved gear teeth.

5. The gripping device of claim 1 in a machine for moving pipes into or out of a well.

6. A pipe gripping device for releasably engaging a pipe, the pipe gripping device comprising:

a housing including a central opening for accepting a pipe therethrough, the central opening extending along an axis;

a first gripping assembly and a second gripping assembly mounted within the housing, the first gripping assembly including a plurality of slip carrier blocks spaced circumferentially about the opening, each slip carrier block having a rear surface and a sloping front face, the sloping front faces together forming a slip bowl bore with a diameter and the slip carrier blocks each being radially moveable between a fully retracted position and an advanced position to adjust the diameter of the bore and a slip slidably mounted on each sloping front face to move over the front face; and the second gripping assembly including a plurality of slip carrier blocks spaced circumferentially about the opening, each slip carrier block having a rear surface and a sloping front face, the sloping front faces together forming a slip bowl bore with a diameter and the slip carrier blocks each being radially moveable between a fully retracted position and an advanced position to adjust the diameter of the bore and a slip slidably mounted on each sloping front face to move over the front face;

the slip bowl bore of the first gripping assembly being tapered in a direction substantially parallel with the axis of the central opening and the slip bowl bore of the second gripping assembly being tapered in a direction opposite the first gripping assembly and the slip carrier blocks of the first gripping assembly being radially moveable independent of the slip carrier blocks of the second gripping assembly, such that pipes having applied thereto a substantially axially directed upward force, relative to the opening, can be selectively gripped by the first gripping assembly and pipes having applied thereto a substantially axially directed downward force, relative to the opening, can be selectively gripped by the second gripping assembly;

a means for driving the radial movement of the carrier blocks of the first gripping assembly and a switch in the first gripping assembly for sensing the proximity of at least one carrier block to the fully retracted position and actuatable to stop radially outward movement of the carrier blocks when the at least one carrier block is at about the fully retracted position; and a means for driving the radial movement of the carrier blocks of the second gripping assembly and a switch in the second gripping assembly for sensing the proximity of at least one carrier block to the fully retracted position and actuatable to stop radially outward movement of the carrier blocks when the at least one carrier block is at about the fully retracted position.

7. The pipe gripping device of claim 6 wherein the means for driving in each of the first and second gripping assembly comprises a spiral gear plate including an annular gear surface and a central opening through the annular gear surface, the spiral gear plate being positioned such that its central opening corresponds with the central opening of the housing and the annular gear surface is in engaging contact with the slip carrier blocks, the annular gear surface having formed thereon elongate gear teeth spiraling inwardly toward the central opening and a wherein the slip carrier blocks each include a plurality of curved gear teeth formed on a surface contacting the spiral gear plate and selected to mesh with the elongate gear teeth of the spiral gear plate, the spiral gear plate being rotatable about the central opening to drive the slip carrier blocks radially by the elongate gear teeth acting against the curved gear teeth.

8. The pipe gripping device of claim 6 wherein the means for driving in each gripping assembly further comprises a hydraulically driven motor and the switch is in controlling communication with a valve positioned to regulate the flow of hydraulic fluid dribing the motor.

9. The pipe gripping device of claim 6 in a machine for moving pipes into or out of a well.

* * * * *